US007328573B2

(12) United States Patent
Rigaudeau et al.

(10) Patent No.: US 7,328,573 B2
(45) Date of Patent: Feb. 12, 2008

(54) AID SYSTEM FOR REGENERATION OF A PARTICLE FILTER FOR AN EXHAUST LINE

(75) Inventors: Christine Rigaudeau, Puteaux (FR); Yvan Agliany, Paris (FR); Marion Wermester, Le Pecq (FR)

(73) Assignee: Peugeot Citroen Automobiles SA, Velizy-Villacoublay (FR)

( * ) Notice: Subject to any disclaimer, the term of this patent is extended or adjusted under 35 U.S.C. 154(b) by 4 days.

(21) Appl. No.: 10/541,548

(22) PCT Filed: Jan. 6, 2004

(86) PCT No.: PCT/FR2004/000006

§ 371 (c)(1),
(2), (4) Date: Apr. 10, 2006

(87) PCT Pub. No.: WO2004/070178

PCT Pub. Date: Aug. 19, 2004

(65) Prior Publication Data

US 2006/0201140 A1 Sep. 14, 2006

(30) Foreign Application Priority Data

Jan. 7, 2003 (FR) ..... 03 00111
Jan. 7, 2003 (FR) ..... 03 00112

(51) Int. Cl.
*F01N 3/00* (2006.01)

(52) U.S. Cl. ..... 60/295; 60/278; 60/280; 60/286; 60/297; 60/311

(58) Field of Classification Search ..... 60/278, 60/280, 286, 295, 297, 311
See application file for complete search history.

(56) References Cited

U.S. PATENT DOCUMENTS 4,835,964 A * 6/1989 Kume et al. ..... 60/285
5,813,223 A * 9/1998 Barthe et al. ..... 60/274
6,378,297 B1 * 4/2002 Ito et al. ..... 60/284
6,952,918 B2 * 10/2005 Imai et al. ..... 60/295
2001/0010152 A1 8/2001 Tallec et al.
2004/0065078 A1 * 4/2004 Schafer-Sindlinger et al. ..... 60/295

FOREIGN PATENT DOCUMENTS

DE 100 48 511 A1 4/2002
EP 1 312 776 A2 5/2003
FR 2 650 029 A 1/1991

OTHER PUBLICATIONS

Patent Abstracts of Japan, Publication No. 2003154223, published May 27, 2003.

* cited by examiner

*Primary Examiner*—Thomas Denion
*Assistant Examiner*—Diem Tran
(74) *Attorney, Agent, or Firm*—Nicolas E. Seckel

(57) ABSTRACT

A system for assisting regeneration of a particle filter of an exhaust line (3) of a diesel engine associated with, in particular:

a particle filter (7);

an oxidation catalytic converter (6);

a common system (8) for feeding fuel to the cylinders of the engine;

means (16) for adding to the fuel an additive adapted to reduce the combustion temperature of the trapped particles and propagate their combustion; and monitoring means (17) for triggering a phase of regeneration of the particle filter by combustion of the particles trapped therein during a phase of multiple injections of fuel;

characterized in that the particle filter (7) is impregnated with a catalyst for oxidizing the hydrocarbons and CO present in the exhaust gases flowing through said particle filter.

27 Claims, 2 Drawing Sheets

AID SYSTEM FOR REGENERATION OF A PARTICLE FILTER FOR AN EXHAUST LINE

BACKGROUND ART

The invention relates to the automotive industry. To be more precise, it relates to the regeneration of particle filters used in particular in diesel engine exhaust lines of vehicles of recent design.

The exhaust lines of diesel engine motor vehicles of recent design are equipped with a particle filter to reduce their emissions of solid pollutants. The walls of the particle filter collect soot which must be eliminated regularly to prevent the particle filter from becoming clogged and to return it to its nominal efficiency. Moreover, clogging of the particle filter gradually creates a back-pressure that degrades the operation of the engine. This elimination of soot, referred to as a "particle filter regeneration", may be effected by heating the filter to a temperature higher than the combustion temperature of soot (which is normally around 550° C.) by means of the exhaust gases flowing therein. To this end, one technical solution consists in:

adding to the fuel, for example when filling the fuel tank, an additive to assist regeneration, whose function is to reduce the combustion temperature of the soot to around 450° C. and to provide available oxygen for propagation of combustion; this additive is mixed with the soot as it is formed in the combustion chamber and is contained within the bed of soot that is deposited in the filter; and periodically carrying out post-injection or multiple injections of fuel on the inlet side of the particle filter, in particular into the cylinders of the engine during their expansion phase.

The effect of the post-injection or multiple injections of fuel is to increase the temperature of the exhaust gases and the quantity of available hydrocarbons that they contain. These hydrocarbons are converted by an oxidation catalytic converter on the input side of the particle filter in an exothermic reaction that heats the exhaust gases to a temperature above 450° C. They then impinge on the bed of soot, where combustion of the soot occurs because of the high temperature of the exhaust gases and the catalytic activity of the additive particles and is propagated by the oxygen made available to the filter medium by the additive.

The additive for assisting regeneration is based on ceria $CeO_2$ and/or on ferric oxide $Fe_2O_3$, for example, or on any metal oxide capable of giving up oxygen. The dose of this additive is generally from a few parts per million (ppm) to 50 ppm of the active material (cerium and/or iron).

SUMMARY OF THE INVENTION

A drawback of the above approach is that periodic regeneration of the particle filter leaves incombustible mineral impurities in the filter medium. Most of these impurities are residues of the additive for assisting regeneration. By soiling the particle filter, they progressively reduce its efficiency, which necessitates regular thorough cleaning of the particle filter, for example every 80,000 kilometers (km) or every 120,000 km.

To increase the period between these thorough cleaning operations, it would be necessary to reduce the quantity of additive for assisting regeneration introduced into the fuel.

The object of the invention is to propose a technical solution to the problem of reducing this quantity without this affecting the efficiency of the reduction of emissions of pollutant materials expelled with the exhaust gases.

To this end, the invention consists in a system for assisting regeneration of a particle filter integrated in an exhaust line of a motor vehicle diesel engine, the engine being associated with various units, including:

means for admitting air into the engine;

means for recycling exhaust gases from the engine to the inlet thereof;

a turbocompressor;

a particle filter including a filter medium adapted to trap particles of soot present in the exhaust gases of said engine;

an oxidation catalytic converter on the upstream side of the particle filter in the exhaust line or combined therewith;

a common system for feeding fuel to the cylinders of the engine, including electrical fuel injectors associated with those cylinders;

means for adding to the fuel an additive adapted to be deposited in the bed of soot particles to reduce the combustion temperature of particles trapped in the particle filter and to propagate their combustion;

means for acquiring information relating to various operating parameters of the engine and the units associated therewith; and means for monitoring the operation of the air admission means, the recycling means, the turbocompressor and/or the fuel feeding system in order to monitor the operation of the engine, these means being further adapted to trigger a phase of regenerating the particle filter by combustion of the particles trapped therein by triggering a phase of multiple injections of fuel into the cylinders of the engine during their expansion phase;

the system being characterized in that said filter medium of said particle filter is coated and/or impregnated with a material capable of constituting a reserve of oxygen adapted to propagate the combustion of the soot during an operation of regenerating the particle filter.

Said material may be cerium oxide.

Said material may be a mixed oxide of cerium and zirconium.

The particle filter may also be coated and/or impregnated with a catalyst encouraging the triggering of reactions tending to reduce the pollutant emissions of the engine.

The particle filter may also be coated and/or impregnated with a catalyst encouraging the triggering of combustion of the soot.

Said catalyst may be a metal from group VIII such as platinum, palladium, or rhodium, or a mixture of such metals.

The distribution of the various materials in the filter may be non-uniform.

The material capable of constituting a reserve of oxygen may be preferentially disposed in the downstream region of the inlet passages of the filter.

The catalyst encouraging triggering of combustion of the soot may be preferentially disposed in the upstream region of the inlet passages of the filter.

The terminal portion of the downstream region of the filter may be free of material constituting a reserve of oxygen and free of catalyst.

The material constituting a reserve of oxygen may be preferentially disposed in the peripheral region of the cross-section of the filter.

The catalyst encouraging the triggering of the combustion of the soot may be preferentially disposed in the central region of the cross-section of the filter.

The invention clearly consists in coating and/or impregnating the filter medium of the particle filter with a composition that serves as a reservoir of oxygen for propagating the reaction of combustion of the soot during the regeneration operation. This composition may also have a catalytic role in initiating combustion of the soot, but it must be clearly understood that it is the function of propagating combustion that is the essential aspect of the invention.

BRIEF DESCRIPTION OF THE DRAWINGS

The invention will be better understood on reading the following description, which is given with reference to the appended drawings, in which.

DETAILED DESCRIPTION OF PARTICULAR EMBODIMENTS

Figure 1:
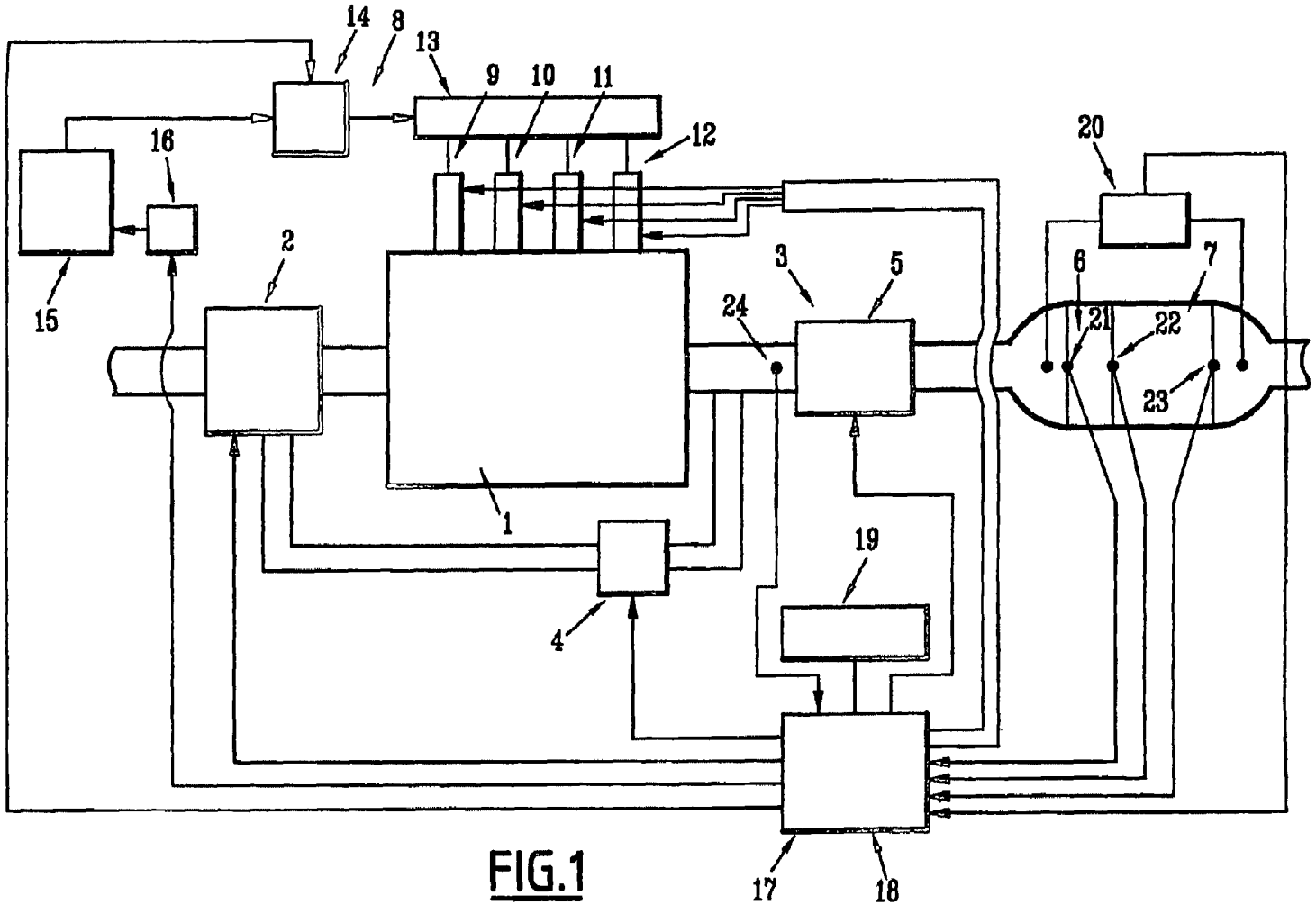
FIG. 1 is a diagram of a vehicle diesel engine and units associated therewith.

FIG. 1 shows a motor vehicle diesel engine 1.

That diesel engine is associated with means 2 for admitting air into the inlet side of the engine.

On its outlet side, the engine is associated with an exhaust line 3.

Means 4 for recycling the exhaust gas from the engine to the inlet side thereof are also provided.

Those means are disposed between the outlet side of the engine and the means 2 for admitting air into the engine, for example.

The exhaust line may also be associated with a turbocompressor 5, and more particularly with the turbine portion thereof, in the conventional way.

Finally, the exhaust line includes an oxidation catalytic converter 6 on the inlet side of a particle filter 7 in the exhaust line.

The engine is also associated with a system 8 common to all the cylinders of the engine for feeding fuel to the cylinders. This system includes electrical injectors associated with the cylinders.

In the embodiment shown, the engine is a four-cylinder engine and therefore has four electrical injectors 9, 10, 11, and 12.

The various injectors are associated with a common fuel supply manifold 13 connected to fuel feed means 14 comprising a high-pressure pump, for example.

The fuel feed means are connected to a fuel tank 15 and to means for adding to the fuel an additive intended to be deposited on the particle filter to reduce the combustion temperature of the particles trapped therein, for example an additive based on ceria and/or ferric oxide (or any metal oxide capable of giving off oxygen).

The additive may be contained in an auxiliary tank 16, for example, associated with the fuel tank 15, to enable a certain quantity of the additive to be injected into the fuel.

Finally, the engine and the various units described above are also associated with means 17 for monitoring their operation, comprising, for example, an appropriate computer 18 associated with information storage means 19 and connected on its input side to various means for acquiring information relating to various operating parameters of the engine 1 and these units, the computer 18 being adapted to monitor the operation of the air admission means 2, the recycling means 4, the turbocompressor 5 and/or the fuel feed means 14 in order to monitor the operation of the engine 1 and in particular the torque generated thereby as a function of the conditions of operation of the vehicle, in the conventional way.

For example, the computer is connected to a differential pressure sensor 20 connected across the combination of the catalytic converter 6 and the particle filter 7, and to temperature sensors 21, 22, and 23 respectively on the inlet side of the catalytic converter 6, between the catalytic converter 6 and the particle filter 7, and on the outlet side of the particle filter 7 in the exhaust line 3.

The computer 18 may also receive information on the oxygen content of the exhaust gases from a Lambda $\lambda$ probe 24 integrated into the exhaust line 3.

The output of the computer 18 is adapted to control the air admission means 2, the exhaust gas recycling means 4, the turbocompressor 5, the means 16 for adding the additive to the fuel, the means 14 for feeding fuel to the common manifold 8 and the various injectors 9-12 associated with the cylinders of the engine 1.

In particular, the computer 18 is adapted to trigger a phase of regenerating the particle filter 7 by combustion of particles trapped therein by instigating a phase of multiple injections of fuel into the cylinders of the engine 1 during their expansion phase.

The particles emitted by the engine 1 while it is operating are trapped in the particle filter. It is then necessary to regenerate the filter regularly by burning off these particles.

Thus, in accordance with the invention, an exhaust line 3 of an internal combustion engine 1 includes a reactor 6 containing an oxidation catalyst (for example a metal such as platinum) for converting hydrocarbons and CO contained in the exhaust gases into $CO_2$ and water vapour by way of an exothermic reaction. This is known in the art.

The exhaust line 3 then includes, in accordance with the invention, a particle filter 7 that has the particular feature of being coated and/or impregnated over the whole or a portion of its surface and/or its volume with a composition such as a material belonging to the group comprising cerium oxide and/or mixed oxide of cerium and zirconium, for example. This composition must be capable of constituting a reserve of oxygen able to propagate combustion of the soot initiated during an operation of regenerating the particle filter 7. In this case the composition is said to have an oxygen storage capacity (OSC).

At the same time, this composition contributes to reducing the soot combustion temperature, exactly like the additive for assisting regeneration commonly introduced into the fuel. However, the introduction of this additive remains necessary even when using a particle filter 7 of the invention because the OSC composition deposited on the particle filter 7 and/or impregnating it (where the term "impregnating" signifies that the composite is present on the surface of the pores situated inside the filter elements constituting the walls of the particle filter) provides only surface contact with the soot. This effect may not be sufficient on its own to reduce the soot combustion temperature to a degree the composite regeneration of the particle filter 7 as quickly as may be required for the intended applications. From this point of view, adding ceria and/or iron oxide (for example) to the fuel causes the additive for assisting regeneration to be incorporated into the soot itself, which achieves the optimum efficiency. Nevertheless, using a particle filter 7 of the invention in conjunction with an additive for assisting regeneration produces a further reduction of the soot combustion temperature, which is obviously highly favorable from the energy point of view. In practice, it is feasible to reduce the soot combustion temperature to 400° C. whereas in the past, for an equal or even greater quantity of additive for assisting regeneration, a combustion temperature of only 450° C. has been achieved.

It goes without saying that if the OSC composition is not uniformly distributed over the whole of the filter medium, it must be preferentially present in the portions of the filter medium in which the soot is mainly captured. This means, for example, the surface of the filter medium that constitutes the inlet of the particle filter 7, in particular the surfaces defining the inlet passages of the particle filter 7 when the filter has the honeycomb structure familiar in the prior art.

The OSC composition may not be the only composition with which the particle filter 7 is coated and/or impregnated. It may be used in conjunction with one or more catalysts that are intended to encourage the initiation of combustion of the soot and/or other reactions tending to reduce pollutant emissions from the engine, for example a metal such as platinum to catalyze oxidation of the hydrocarbons and CO, a catalyst for treating nitrogen oxides, etc. It may therefore be envisaged that some or all of the conversion of the hydrocarbons and CO should happen in the particle filter 7 itself, and not necessarily in a separate medium 6 on the inlet side of the particle filter 7. In this case, FIG. 1 could be modified by the regions 6 and 7 being combined and the temperature sensor 22 being eliminated.

For example, the OSC composition may be associated with a washcoat deposited on the particle filter 7. The addition to the filter of a washcoat consisting of Ce oxide or mixed Ce/Zr oxide capable of providing oxygen during combustion contributes to improving the oxidation of the soot by reducing the temperature at which combustion is initiated, as well as improving the propagation of combustion.

The OSC composition may further be associated with a catalyst formed by a metal from group VIII of the periodic table or a mixture of such metals, such as platinum and/or palladium and/or rhodium, and therefore oxidize the soot either directly, because of the availability of activated oxygen, or indirectly, through the exothermic reactions of oxidizing the hydrocarbons and the CO occurring on the platinum, palladium, or rhodium. This reduces the emission of pollutants and locally increases the temperature, which indirectly assists oxidation of the soot.

The platinum and/or palladium and/or rhodium may either be merely deposited on a washcoat of $Al_2O_3$, or it may be mixed with the washcoat or with the OSC composition.

The washcoat deposited on the particle filter may consist of alumina (constituting a catalyst support of large surface area) to which cerium oxide ($CeO_2$) and/or mixed cerium and zirconium oxide ($Ce_xZr_yO_2$) is or are added in variable proportions, which oxide(s) may be intimately bonded to the alumina. The quantity of washcoat may vary from a few grams per liter (g/l) to a few tens of g/l.

The precious metals must be sufficiently dispersed and stable to remain accessible and effective for converting the pollutants. The quantity of precious metals depends on the quantity of washcoat and may vary from a few tenths of a gram to several grams over the whole of the particle filter, depending on the function of the precious metals. Several grams are generally necessary for treatment of exhaust gases.

FIGS. 2 to 5 are diagrams of examples of the distribution of the various compositions discussed above over the length of the inlet passages 25 of the particle filter 7. In these examples, the outlet passages 26 of the particle filter 7 are not impregnated, but they could obviously be impregnated if this were deemed beneficial for completing reactions initiated in the inlet passages 25.

Figure 2:
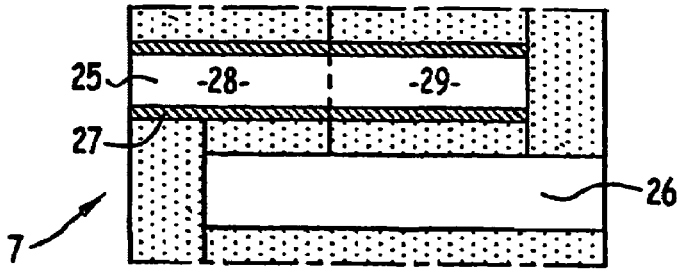
FIGS. 2 to 4 are diagrams in longitudinal section of examples of particle filters that may be used in the context of the invention and show various ways in which the compositions contained therein can be distributed.

In FIG. 2, the whole surface of the inlet passages 25 of the particle filter 7 is impregnated with a single layer 27 comprising the OSC material, a metal catalyst, and a washcoat. This layer 27 may be homogeneous in terms of quantity and composition over the whole length of the passages 25. These characteristics may also vary along the passages 25:

- to oxidize the hydrocarbons and CO more quickly, the quantity of metal catalyst may be greater in the upstream region (28) of each passage 25 than in the downstream region (29), said upstream region representing from 10% to 50% of the length of the passage 25, for example, and the catalyst content of the upstream region 28 may be from 1.5 to 5 times that of the downstream region 29, for example; and
- to encourage initiation of combustion of the soot primarily in the downstream region 29, i.e. where the soot tends to accumulate preferentially, the quantity of OSC material may be greater in the downstream region 29 of each passage 25 than in the upstream region 28, said downstream region representing from 10% to 50% of the length of the passage 25, for example.

Figure 3:
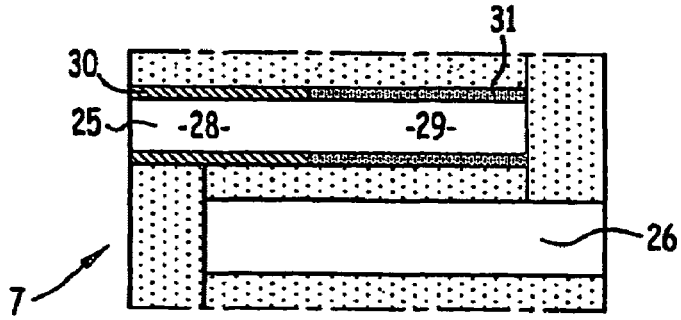

In FIG. 3, the upstream region 28 of the passages 25 is impregnated with a layer 30 comprising the OSC material, the metal catalyst and the washcoat and the downstream region 29 is impregnated with a layer 31 comprising only the OSC material and the washcoat. Alternatively, the OSC material could be absent from the upstream region.

Figure 4:
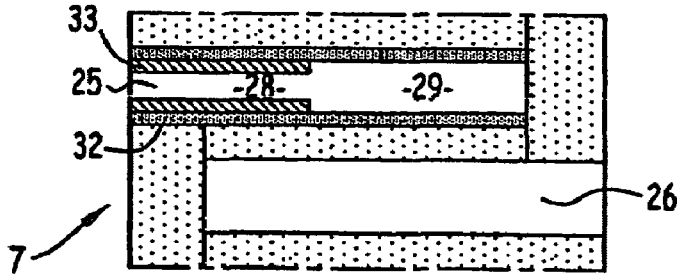

In FIG. 4, the upstream region 28 of the passages 25 is impregnated with a layer 32 comprising the OSC material and the washcoat, said layer 32 being itself coated with a layer 33 comprising the metal catalyst and the washcoat. The downstream region 29 of the passages 25 is impregnated only with the layer 32 of the OSC material and the washcoat.

In all the configurations discussed, there is the option of not providing any coating and/or impregnation in the downstream region 29, or at least in the terminal portion thereof. This is where impurities, ash and residues remaining after combustion of the soot tend to accumulate, and these impurities degrade the functioning of the catalysts. Eliminating the catalysts in regions where they would be less effective than in the remainder of the particle filter 7 anyway economizes on materials and limits the head losses of the gases in the particle filter 7.

Figure 5:
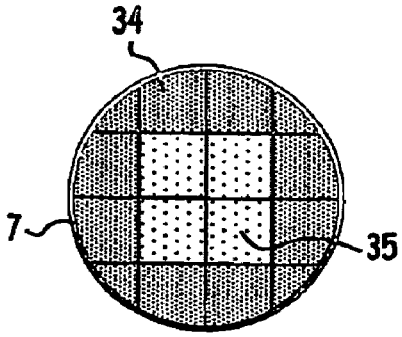
FIGS. 5 and 6 are diagrams in cross-section of two examples of radial distribution for the compositions contained in a particle filter usable in the context of the invention.
Figure 6:
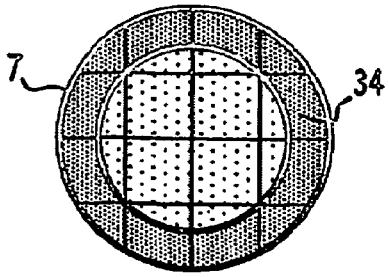

Similarly, as can be seen in FIGS. 5 and 6, the distribution of the catalysts may be modulated across the cross-section of the particle filter 7.

FIG. 5 shows a particle filter 7 in cross-section. The lateral modules 34 are impregnated with a greater quantity of the OSC material than the more central modules 35, for example.

In this variant, the OSC material is substantially homogeneously distributed within each module. This need not always be the case, for example as shown in FIG. 6, where portions of the lateral modules 34 are also included in the more weakly impregnated region so that said region has a substantially circular cross-section.

The more strongly impregnated region typically represents from 30% to 80% of the area of the cross-section of the particle filter 7. In this region, the quantity of OSC material is typically of the order of 1.5 to 5 times that in the more weakly impregnated regions.

The object of this kind of distribution of the OSC material is to provide oxygen preferentially where it is more difficult to convert the soot, i.e. at the periphery of the particle filter 7, where the thermal conditions are the least favorable.

The distribution of the other materials with which the particle filter 7 is impregnated may also be modulated over the cross-section of the particle filter 7, but not necessarily in the same direction as the OSC material. Thus it is preferable to favor the most central modules 35 for impregnation by the metal catalyst in order to convert the hydrocarbons and CO preferentially where the thermal and flow conditions are most favorable to this effect. Once again, the more strongly impregnated regions may typically contain from 1.5 to 5 times more metal catalyst than the more weakly impregnated regions.

In practice, it is advantageous to exploit the use of a particle filter 7 of the invention by reducing the quantity of additive used for assisting regeneration (by around 50% or more). The effect of this is to reduce the quantity of incombustible residues deposited in the particle filter 7 and therefore to make thorough cleaning necessary less often.

It must be understood that the application of a particle filter 7 of the invention to diesel engine exhaust lines is merely one preferred application of the invention. A particle filter 7 of the invention would be usable on an exhaust line of any other type of internal combustion engine for which a particle filter 7 would be beneficial.

The invention claimed is:

1. A system for assisting regeneration of a particle filter integrated in an exhaust line of a motor vehicle diesel engine, the engine being associated with various units, including:

means for admitting air into the engine;

means for recycling exhaust gases from the engine to the inlet thereof;

a turbocompressor;

a particle filter including a filter medium adapted to trap particles of soot present in the exhaust gases of said engine;

an oxidation catalytic converter on the upstream side of the particle filter in the exhaust line or combined therewith;

a common system for feeding fuel to the cylinders of the engine, including electrical fuel injectors associated with those cylinders;

means for adding to the fuel an additive adapted to be deposited in the bed of soot particles to reduce the combustion temperature of particles trapped in the particle filter and to propagate their combustion;

means for acquiring information relating to various operating parameters of the engine and the units associated therewith;

means for monitoring the operation of at least one of the air admission means, the recycling means, the turbocompressor and the fuel feeding system in order to monitor the operation of the engine, these means being further adapted to trigger a phase of regenerating the particle filter by combustion of the particles trapped therein by triggering a phase of multiple injections of fuel into the cylinders of the engine during their expansion phase;

wherein said filter medium of said particle filter is at least one of (i) coated and (ii) impregnated with a material capable of constituting a reserve of oxygen adapted to propagate the combustion of the soot during an operation of regenerating the particle filter, and wherein the distribution of the various materials in the filter is non uniform and the terminal portion of the downstream region of the filter contains no material constituting a reserve of oxygen and no catalyst.

2. A system according to claim 1, wherein said material is cerium oxide.

3. A system according to claim 1, wherein said material is a mixed oxide of cerium and zirconium.

4. A system according to claim 1, wherein the material capable of constituting a reserve of oxygen is preferentially disposed in the downstream region of the inlet passages of the filter.

5. A system according to claim 1, wherein the material constituting a reserve of oxygen is preferentially disposed in the peripheral region of the cross-section of the filter.

6. A system according to claim 1, wherein the particle filter is also at least one of (i) coated and (ii) impregnated with a catalyst encouraging the triggering of reactions tending to reduce the pollutant emissions of the engine.

7. A system according to claim 6, wherein the particle filter is also at least one of (i) coated and (ii) impregnated with a catalyst encouraging the triggering of combustion of the soot.

8. A system according to claim 7, wherein the distribution of the various materials in the filter is non-uniform, and wherein the catalyst encouraging the triggering of the combustion of the soot is preferentially disposed in the upstream region of the inlet passages of the filter.

9. A system according to claim 7, wherein the distribution of the various materials in the filter is non-uniform, and wherein the catalyst encouraging the triggering of the combustion of the soot is preferentially disposed in the central region of the cross-section of the filter.

10. A system according to claim 6, wherein said catalyst is selected from (i) metals from group VIII and (ii) mixtures of metals from group VIII.

11. A system according to claim 10, wherein the catalyst is selected from platinum, palladium, rhodium, and mixtures of said metals.

12. A system for assisting regeneration of a particle filter integrated in an exhaust line of a motor vehicle diesel engine, the engine being associated with various units, including:

means for admitting air into the engine;

means for recycling exhaust gases from the engine to the inlet thereof;

a turbocompressor;

a particle filter including a filter medium adapted to trap particles of soot present in the exhaust gases of said engine;

an oxidation catalytic converter on the upstream side of the particle filter in the exhaust line or combined therewith;

a common system for feeding fuel to the cylinders of the engine, including electrical fuel injectors associated with those cylinders;

means for adding to the fuel an additive adapted to be deposited in the bed of soot particles to reduce the combustion temperature of particles trapped in the particle filter and to propagate their combustion;

means for acquiring information relating to various operating parameters of the engine and the units associated therewith;

means for monitoring the operation of at least one of the air admission means, the recycling means, the turbocompressor and the fuel feeding system in order to monitor the operation of the engine, these means being further adapted to trigger a phase of regenerating the particle filter by combustion of the particles trapped therein by triggering a phase of multiple injections of fuel into the cylinders of the engine during their expansion phase;

wherein said filter medium of said particle filter is at least one of (i) coated and (ii) impregnated with a material capable of constituting a reserve of oxygen adapted to propagate the combustion of the soot during an operation of regenerating the particle filter, and wherein the distribution of the various materials in the filter is non uniform and the material constituting a reserve of oxygen is preferentially disposed in the peripheral region of the cross-section of the filter.

13. A system according to claim 12, wherein said material is cerium oxide.

14. A system according to claim 12, wherein said material is a mixed oxide of cerium and zirconium.

15. A system according to claim 12, wherein the material capable of constituting a reserve of oxygen is preferentially disposed in the downstream region of the inlet passages of the filter.

16. A system according to claim 12, wherein the particle filter is also at least one of (i) coated and (ii) impregnated with a catalyst encouraging the triggering of reactions tending to reduce the pollutant emissions of the engine.

17. A system according to claim 16, wherein the particle filter is also at least one of (i) coated and (ii) impregnated with a catalyst encouraging the triggering of combustion of the soot.

18. A system according to claim 17, wherein the distribution of the various materials in the filter is non-uniform, and wherein the catalyst encouraging the triggering of the combustion of the soot is preferentially disposed in the upstream region of the inlet passages of the filter.

19. A system according to claim 16, wherein said catalyst is selected from (i) metals from group VIII and (ii) mixtures of metals from group VIII.

20. A system according to claim 19, wherein the catalyst is selected from platinum, palladium, rhodium, and mixtures of said metals.

21. A system for assisting regeneration of a particle filter integrated in an exhaust line of a motor vehicle diesel engine, the engine being associated with various units, including:

means for admitting air into the engine;

means for recycling exhaust gases from the engine to the inlet thereof;

a turbocompressor;

a particle filter including a filter medium adapted to trap particles of soot present in the exhaust gases of said engine;

an oxidation catalytic converter on the upstream side of the particle filter in the exhaust line or combined therewith;

a common system for feeding fuel to the cylinders of the engine, including electrical fuel injectors associated with those cylinders;

means for adding to the fuel an additive adapted to be deposited in the bed of soot particles to reduce the combustion temperature of particles trapped in the particle filter and to propagate their combustion;

means for acquiring information relating to various operating parameters of the engine and the units associated therewith;

means for monitoring the operation of at least one of the air admission means, the recycling means, the turbocompressor and the fuel feeding system in order to monitor the operation of the engine, these means being further adapted to trigger a phase of regenerating the particle filter by combustion of the particles trapped therein by triggering a phase of multiple injections of fuel into the cylinders of the engine during their expansion phase;

wherein said filter medium of said particle filter is at least one of (i) coated and (ii) impregnated with a material capable of constituting a reserve of oxygen adapted to propagate the combustion of the soot during an operation of regenerating the particle filter, wherein the particle filter is also at least one of (i) coated and (ii) impregnated with a catalyst encouraging the triggering of reactions tending to reduce the pollutant emissions of the engine, wherein the particle filter is also at least one of (i) coated and (ii) impregnated with a catalyst encouraging the triggering of combustion of the soot, and wherein the distribution of the various materials in the filter is non-uniform, and the catalyst encouraging the triggering of the combustion of the soot is preferentially disposed in the central region of the cross-section of the filter.

22. A system according to claim 21, wherein said material is cerium oxide.

23. A system according to claim 21, wherein said material is a mixed oxide of cerium and zirconium.

24. A system according to claim 21, wherein the material capable of constituting a reserve of oxygen is preferentially disposed in the downstream region of the inlet passages of the filter.

25. A system according to claim 21, wherein the distribution of the various materials in the filter is non-uniform, and wherein the catalyst encouraging the triggering of the combustion of the soot is preferentially disposed in the upstream region of the inlet passages of the filter.

26. A system according to claim 21, wherein said catalyst is selected from (i) metals from group VIII and (ii) mixtures of metals from group VIII.

27. A system according to claim 26, wherein the catalyst is selected from platinum, palladium, rhodium, and mixtures of said metals.

* * * * *